United States Patent [19]

Rotter et al.

[11] Patent Number: 4,986,498

[45] Date of Patent: Jan. 22, 1991

[54] DEVICE FOR DETERMINING THE CONDITION OF RAILWAY SWITCHES OR RAILWAY CROSSINGS

[75] Inventors: Franz Rotter; Wolfgang Nayer, both of Zeltweg; Heribert Quantschnigg; Erich Sattler, both of Weisskirchen, all of Austria

[73] Assignee: Voest-Alpine Maschinenbau Gesellschaft m.b.H., Linz, Austria

[21] Appl. No.: 356,303

[22] Filed: May 24, 1989

[30] Foreign Application Priority Data

May 27, 1988 [AT] Austria ..... 1395/88
Nov. 3, 1988 [AT] Austria ..... 2708/88

[51] Int. Cl.[5] ..... E01B 7/20; B61L 23/04

[52] U.S. Cl. ..... 246/458; 246/1 C; 246/220

[58] Field of Search ..... 246/1 C, 218, 220, 253, 246/454, 382, 435 R, 458, 468, 169 R

[56] References Cited

U.S. PATENT DOCUMENTS 4,093,163 6/1978 Larsson ..... 246/435 R X

FOREIGN PATENT DOCUMENTS 358625 2/1978 Austria .
153900 1/1985 European Pat. Off. .
2636359 5/1978 Fed. Rep. of Germany .

*Primary Examiner*—Robert P. Olszewski
*Assistant Examiner*—A. Muratori
*Attorney, Agent, or Firm*—Cushman, Darby & Cushman

[57] ABSTRACT

A device for determining the condition of railway switches or railway crossings by monitoring the end position of tongue rails (2), said device having a sensor (18) within the area of the theoretical frog point (17) of a frog (8), said sensor giving on occasion of a mechanical collision with the wheel flange or with the running surface of the wheel a signal indicating premature wear within the area of the frog.

22 Claims, 4 Drawing Sheets

DEVICE FOR DETERMINING THE CONDITION OF RAILWAY SWITCHES OR RAILWAY CROSSINGS

BACKGROUND OF THE INVENTION

1. Field of the Invention

The invention refers to a device for determining the condition of railway switches or railway crossings comprising sensors for monitoring the end position of tongue rails, in particular for the diagnosis of the wear and for laying down maintainance intervals.

2. Description of the Prior Art

Monitoring devices for the spatial position of swivelable rails can be derived, for example, from AT-PS 358 625. The known monitoring devices having been used in connection with railway switches and railway crossings were restricted to provide repeating signals for the end positions of swivelable rails, so that the track can be given free after the correct end position of the swivelable rails has been acknowledged. Such devices were primarily used in remote control devices and, respectively, in interlocking posts or local control devices, and from EP-A-153 900 it has already become known to incorporate into the control of the end position also the surveyance of the switch drive means. Premature wear of switch parts can only insufficiently be recognized by such devices and it is in particular not possible to establish with the known devices a diagnosis system which is capable of determining data that is important for the operation of the switch at a distance from the switch drive means itself and, respectively, from the ends of the tongue rails and which is in particular capable of recognizing premature wear.

SUMMARY OF THE INVENTION

The invention now aims at providing a device of the initially mentioned type by means of which it becomes additionally possible to obtain data concerning the condition of the switch, in particular concerning the wear of the switch. For solving this task, the device according to the invention essentially consists of a sensor arranged within the area of the theoretical frog point for determining deviations of the wheel motion in a lateral direction and/or in a height direction. On account of a sensor being provided within the area of the theoretical frog point for sensing deviations of the wheel motion in a lateral direction and/or in height direction, it becomes now possible to determine an inadmissible wear or, respectively, variations of the guide width which may result in premature wear of the frog. While the known sensors for determining the end position of the tongue rails may, in a usual manner, be designed as inductive proximity switches, because the signal indicating once the arrival at the end position is sufficient for giving free the track and need not be checked while the switch is travelled upon, such a sensor arranged within the area of the theoretical frog point must be designed in such a manner that it transmits reliable signals even when the switch has just been travelled upon. For this reason, the arrangement according to the invention is in a simple manner selected such that the sensor is designed as a switch, the actuating member of which is supported for being swivelable around a crossing axis extending in essentially normal relation to the plane of the rail surface or extending essentially in parallel relation to the plane of the rail surface and extending in direction of the angle bisector of the frog. Such a simple switch can be actuated by swivelling the actuating member around its respective swivelling axis, given a correspondingly strong design and shielded against disturbing influences of electromagnetic fields.

In a particularly simple manner, the actuating member of the switch can be given a conical shape that conically flares from the upper edge in a downward direction and from the front end in a direction towards the frog point. As long as no excessive wear takes place, such an actuating member for the switch is contacted neither by the wheel flange of the wheels nor by the running surfaces of the wheels and the switch is thus not actuated as long as such a collision of the wheel flange or, respectively, of the running surface with the actuating member does not take place. For the purpose of detecting deviations in height direction, shifting movement of the actuating member in vertical direction can be admitted in addition to the swivelability of the actuating member. The arrangement can advantageously be selected such that a further pressure sensor for sensing vertical forces is connected with the bearing support of the actuating member.

According to an alternative embodiment for a sensor arranged within the area of the theoretical frog point, the arrangement is preferably such that the sensor is formed of two spring leaves being connected one with the other under an acute angle and having fixed to their side surfaces wire strain gauges and having their free ends fixed on a base plate, in particular on a sleeper. On account of the sensor having such a configuration, the direction as well as the degree of a deviation of the wheel motion can continuously be determined. It is in particular possible to unambiguously determine the direction in which the sensor is loaded, because, when arranging wire strain gauges on the side surfaces of the spring leaves, one of the wire strain gauges is subjected to tension load and the other is subjected to pressure load. If both wire strain gauges are subjected to load in the same sense, a deviation of the wheel motion in height direction can be concluded. In case a theoretically possible exactly vertical load on the spring leaves, no signal can be derived from the sensor because the resistance of the wire strain gauges is simultaneously varied in the same sense. There must always exist at least one horizontal component of the load, which is the case at any rate on account of the inclination of the running surface of the wheels of rail vehicles, so that also deviations in height direction can be reliably detected.

On account of such a design of the sensor, the construction can further be simplified and the expenditure for evaluating the sensor signals is reduced. In particular, it becomes possible to obtain with a minimum number of sensors a nearly complete information on the wear condition and to make simultaneous statements on inadmissible deviations of the wheel motion in a lateral direction and in a height direction. Furthermore, it is possible to detect the degree of such deviations, so that the respective admissible limit values for the deviation can, in this manner, be defined via the evaluating circuit independent from the design of the sensor.

For the purpose of obtaining great output signals with wire strain gauges of maximum simplicity and in cases of small deformations, the arrangement is, preferably selected such that the free ends of the spring leaves are bent in an outward direction and the wire strain gauges are arranged on the side surfaces within the area of these bends. On account of arranging the wire strain gauges within the area of the bends of the side surfaces, there are obtained relatively great measured signals even in cases of only small bending deformation within the tip area of the sensor, so that there a high detection accuracy and measuring accuracy results. For the purpose of protecting the wire strain gauges against weathering and against unintended damaging, the arrangement is preferably selected such that the wire strain gauges are arranged on the mutually facing inner surfaces of the spring leaves.

In principle, the spring leaves themselves may be designed in such a manner that their outer sides are not in alignment with the lateral flanks of the frog but are staggered in inward direction, noting that, for the purpose of obtaining in such cases exact measured values, the arrangement must be such that a sensing head of the required width must be connected to the connecting area of the spring leaves. The arrangement can advantageously be selected in this case such that the sensor has a spherical head within the connecting area between the spring leaves.

For the purpose of further reducing the danger of damaging the sensor, the arrangement is advantageously selected such that the acute angle included between the spring leaves or, respectively, the angle between the flanks of the swivelable sensor corresponds to the flank angle of the frog point.

For further protecting the sensor and, in particular, the electrical connections to the wire strain gauges, the arrangement can be developed further advantageously such that the free space existing between the spring leaves is filled with a compound of permanent elasticity, in particular synthetic resin or foam material.

The area of the theoretical frog point extends in principle from the actual or, respectively, effective frog point beyond the mathematical frog point because such an area is not exactly limited. According to the invention, it is preferred to arrange such a sensor between the mathematical or, respectively, theoretical frog point and the effective frog point, noting that such an arrangement provides the possibility to effectively protect the sensor against inadmissible deformation. For this purpose, the arrangement is advantageously such that a rigid protecting means is arranged in direction to the theoretical frog point. This rigid protecting means must, for resisting the acting load, of course have its end in front of the mathematical or, respectively, theoretical frog point and care must be taken of the required width of the groove through which runs the wheel flange.

According to a further preferred embodiment, the sensor is a non-contact sensor and is designed as an IR-sensor. On account of using such a non-contact sensor, in particular an IR-sensor, it becomes in a simple manner possible to determine the distance between the sensor and the wheel in vertical direction as well as in horizontal direction, so that a wear of the rails within the area of the frog point can be concluded from a fall below certain limit values of the distance.

In principle, it would be also conceiveable to determine the distance by using non-contact induction transmitters, noting that on account of the electromagnetic stray fields produced by electric locomotives a great expenditure would become necessary for reliably separating a signal from disturbing effects.

A complete picture of the functionally condition of the railway switch can be obtained by means of additional sensors being partially known per se. As such additional sensors there can be used usual inductive or capacitive proximity switches because these additional informations need only be measured in a static condition but not when the railway switch is travelled upon. For the purpose of recognizing a premature wear, it is particularly advantageous if there are additionally provided at a distance from the end of the tongue rail sensors known per se for monitoring the minimum distance of the stock rail from the tongue rail. Such additional sensors arranged at a distance from the end of the tongue rail provide information on the narrowest passage, which up till now was only checked at irregular intervals or, respectively, was only visually checked.

Beside monitoring the end positions of the tongue rails by sensors provided on a control link or by checking the contact of the tongue rail and evaluating this contact as an end position signal, it is particularly advantageous for an inventive device intended for the diagnosis of the functional condition, if the arrangement is selected such that there is connected with the current supply for the drive means of the railway switch a means, in particular an ammeter, detecting the current input, the measured values of this means being monitored during the time of the switching operation and being indicated in an indicating device. Such continuous monitoring of the current input of the switch drive means during the switching operation allows an early conclusion on inadmissible wear phenomenae or, respectively, on insufficient lubrication. If, for example, the current input is reduced in an atypical manner, this may indicate a fracture of the tongue or of the control link, and, if the current input is increasing in an atypical manner, one may conclude a lack of lubrication or the presence of icing or mechanical damage.

A complete picture of the operating condition of a railway switch can only be obtained if the screw connection between the frog point and the wing rails is monitored if this type of frog is used. For this purpose, the arrangement is advantageously such that additional sensors for monitoring the fixation of the frog screws are, in particular, arranged between the screw head and the washer or on the screw head and are connected with an evaluating circuit via measuring conduits.

The sensors, known per se, for monitoring the end position of the tongue rails, can, in connection with the device for performing a diagnosis process for railway switches, advantageously be designed and used such that the sensors for monitoring the end position of the tongue rails are, in a manner known per se, designed as non-contact sensors, in particular as inductive sensors or IR-sensors, and that the signal indicating the contact of the tongue rail on a stock rail as well as the signal indicating a distance from the contacting position is supplied to an evaluating circuit. On account of the signal indicating the contact of the tongue rails on a stock rail as well as the signal indicating a distance from the contact position being evaluated, a wear on the engaging surface of the tongue and, respectively, a foreign body having entered can also within this area be recognized by evaluating the value indicated for the distance.

According to a preferred embodiment, the arrangement is selected such that by providing mechanical sensors for monitoring the contacting position of the tongue rail over the whole length, a conclusion on the wear condition and, respectively, the penetration of foreign bodies between stock rail and tongue rail becomes possible by evaluating the distance from the contacting position, so that the condition of the tongue rail can be checked over a wide range and the wear of the tongue rail is not only checked on its tip area.

A further possibility for checking results, in a preferred embodiment, if by arranging a non-contact sensor or, respectively, a mechanical sensor within the narrowest passage between the stock rail and the tongue rail there is recognized a reduction of the distance below the limit value in continuous operation and damaging of the components can be prevented by starting preventive measures in time.

BRIEF DESCRIPTION OF THE DRAWING

In the following, the invention is further explained with reference to examples of embodiment schematically shown in the drawing.

DETAILED DESCRIPTION OF THE PREFERRED EMBODIMENTS

Figure 1:
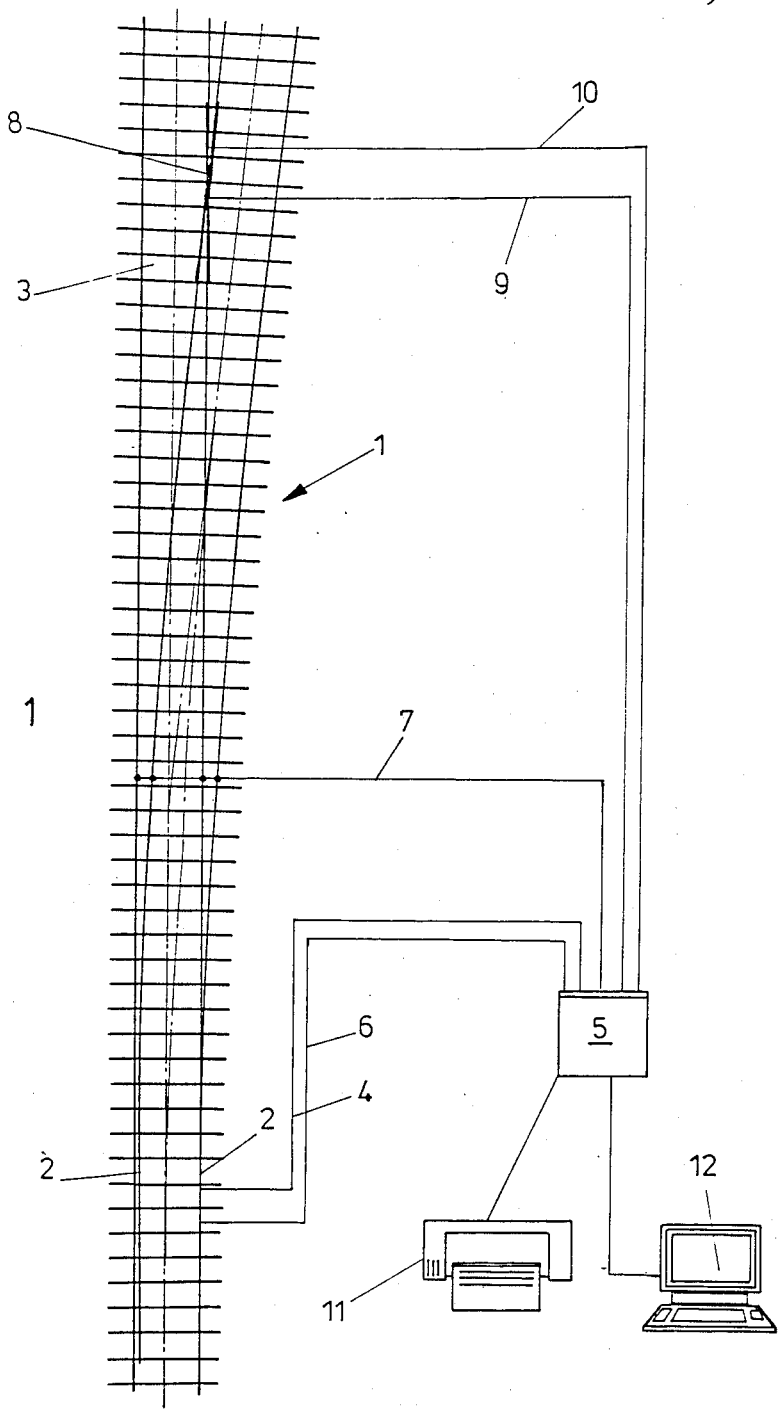
FIG. 1 shows schematically an overall arrangement of a diagnosis device according to the invention.

In FIG. 1, there is indicated a railway switch 1, the tongue rail 2 of which is shown in a position giving free the track 3 which further extends in straight direction. Within the area of the ends of the tongue rails, there is acting the usual switch drive means for railway switches and the known security means. Within this area, there can be provided sensors for the tongue position as well as for the smallest passage at a distance from the ends of the tongue rails. The associated signal conduit is schematically indicated by 4 and connected with an evaluating circuit 5. The switching force of the drive means for the railway switch and in particular the current consumption of the drive means for the railway switch can equally be evaluated by the evaluating circuit 5, the associated control conduits being designated by 6. In addition, there is schematically indicated by a signal conduit 7, a remote supervision of the insulated joint or, optionally, of a railway switch heating means.

The sensors used within this area are all of usual type and described in detail in the literature, so that a detailed illustration can be omitted in the present case.

Within the area of the frog 8, there can, as will be explained later in greater detail, be checked the guide width, the guide rail groove and the wear of the height, respectively, via signal conduits 9. Measured values for the correct screw connection of the frog can be supplied via a signal conduit 10 to the evaluating circuit 5. The signals of the evaluating circuit 5 can be processed within a master computer 11 and be indicated, if required, via an indicating device 12 or be recorded.

Figure 2:
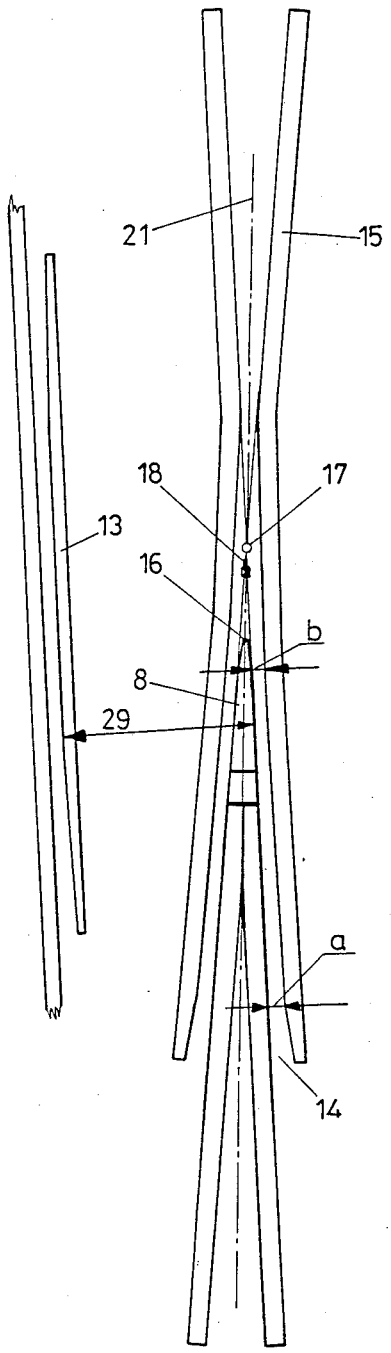
FIG. 2 shows in an enlarged scale a frog of a railway switch having arranged in its tip area a switch according to the invention.

The sensor arrangement provided within the area of the frog 8 is shown in greater detail in FIG. 2. The area of the frog is shown in FIG. 2 at a greater scale, noting that an area of an outwardly located track rail is indicated with a guide rail 13 at a non-correct scale. A knee rail 15 is located adjacent the frog 8, noting that there is first provided a catching opening 14 tapering to the inlet width a between the frog and the knee rail. The groove width between frog point and knee rail is designated by b. The effective frog point 16 is located at a distance from the theoretical mathematical frog point 17 which represents the point of intersection of the imaginary extensions of the flanks of the frog point. A sensor 18 delivering information on an inadmissible wear is now arranged between the effective frog point 16 and the mathematical frog point 17. Immediately adjacent the sensor 18 there is arranged a protective means 30 in direction to the mathematical or, respectively, theoretical frog point 17.

Figure 3:
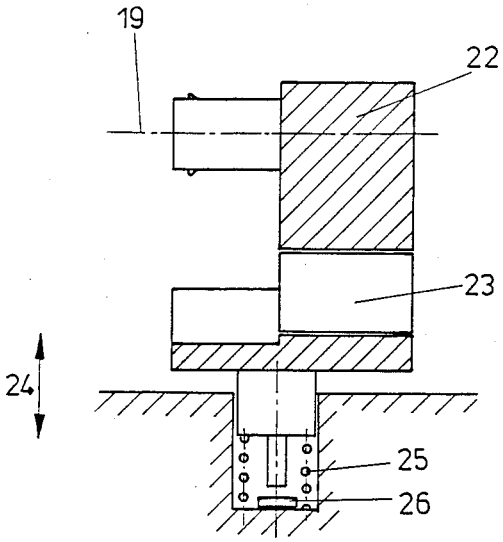
FIG. 3 shows a section in direction of the angle bisector of the frog through a first embodiment of an inventive sensor with the actuating member being removed.
Figure 4:
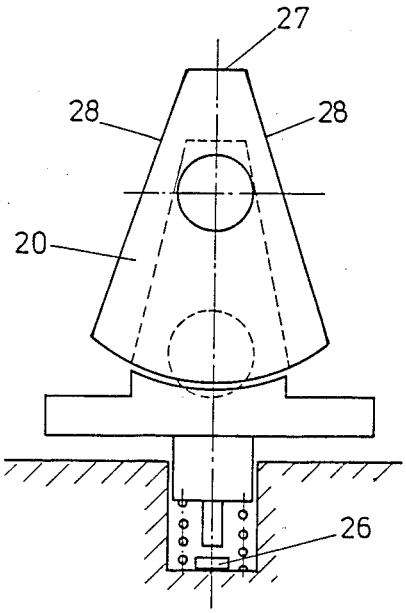
FIG. 4 shows in longitudinal direction of the rail a view of the switch according to FIG. 3, the actuating member being located within the area of the frog point.

A first embodiment of the sensor 18 has, as is shown in FIGS. 3 and 4, an actuating member 20 being available around an axis 19. The swivelling axis 19 extends in parallel relation to the angle bisector 21 of the frog 8, as is shown in FIG. 2. The carrier part 22, to which the actuating member 20 is swivelably linked, carries a receiving opening 23 for a switch being actuated by swivelling the actuating member 20. Additionally, there can be provided, as is shown in the FIGS. 3 and 4, a possibility to shift the carrier part 22 in an essentially vertical direction in the sense of the twin arrow 24 for the purpose of detecting deviations in height direction and in particular a collision of the running face of the wheel with the switch in a reliable manner. For this purpose, the carrier 22 is spring-loaded by a spring 25 and a further pressure sensor 26 is provided below the carrier for giving a response when the running surface of the wheel hits the upper edge 27 of the actuating member. Excessive wear or, respectively, non-tolerable underpassing of the guide width 29, which is defined by the distance between the guide rail 13 and the frog 8, is signaled even if the wheel flange of a wheel comes into collision with the lateral flanks 28 of the actuating member 20, because the actuating member is, in this case, swivelled about the axis 19 and the switch within the receiving opening 23 is actuated. In this embodiment, a protective means is not illustrated.

Figure 5:
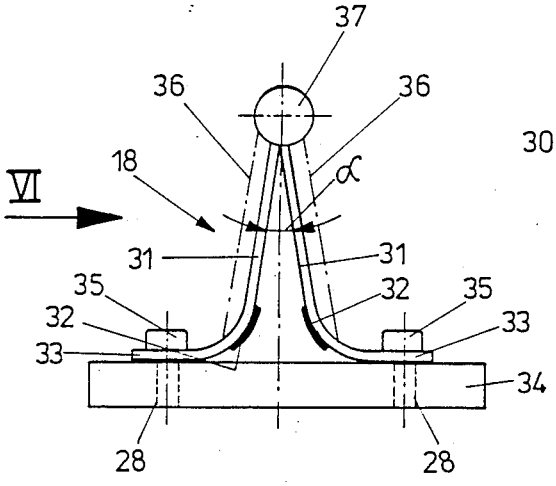
FIG. 5 shows in a greater scale a view of a modified embodiment of the sensor according to the invention.

A modified embodiment of the sensor 18 being shown in FIG. 5 in an enlarged scale is formed of two spring leaves 31 including one with the other an acute angle $\alpha$ and having arranged wire strain gauges 32 on their side surfaces located at the inner side. The free ends of the spring leaves 31 are bent in an outward direction and the wire strain gauges are arranged within the area of the bent portions, noting that the free ends 33 of the spring leaves are fixed on a base plate 34, for example by means of screw connections 35. The acute angle included by the spring leaves 31 corresponds, in this case, essentially to the flank angle of the frog point, noting that the flanks of the frog are schematically shown in FIG. 5 by the dashed lines 36. A similar contour has, in this case, the protective means 30 located adjacent the sensor 18 and in direction to the mathematical frog point. From FIG. 5, there can also be derived the crowned head 37 being provided at the connecting area of the spring leaves 31.

Figure 6:
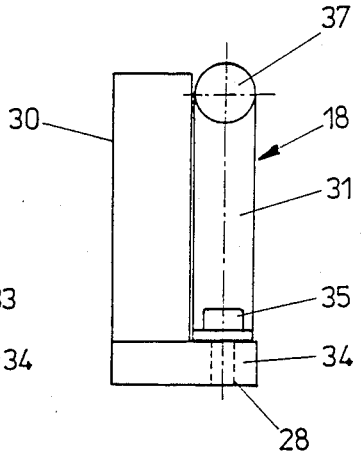
FIG. 6 shows a side elevation of the sensor according to FIG. 5 in direction of the arrow VI together with a protective means being arranged in close proximity.

In FIGS. 5 and 6 there is shown the manner of mounting the sensor 18, which is formed of the two spring leaves, together with the wire strain gauges arranged thereon on the common base plate 34 in greater detail. The free ends of the spring leaves 31 are fixed in this case, in bore 38 of the base plate 34, while the protective means 30 is connected with the base plate 34 by welding.

For the purpose of protecting the spring leaves 31 and in particular the wire strain gauges 32 arranged on the inner side thereof within the bent area, the free space between the spring leaves 31 is filled with a compound of permanent elasticity, in particular with synthetic resin or foam material.

In addition to these basic informations on the wear condition of guide rails and, respectively, knee rail and frog, it is possible to obtain a substantially complete supervision of the functional safety of a railway switch via the other sensors schematically shown in FIG. 1 and in particular via the pressure cells arranged between the washers and the heads of the frog screws and it is possible to predetermine, on account of the continuous supervision of the drive means for the railway switch and on account of the analogous evaluation of the actual distances being met also in case of a non-contacting tongue rail, at an early moment when the next maintainance work has to be made for a railway switch monitored in this manner. It is in particular the continuous measurement of the guide width by means of contacting and non-contacting measuring means which delivers additional information which can not easily be obtained when using exclusive non-contacting measuring means. It is primarily the supervision of defined limit values and guide values during travelling on the railway switches which allows to recognize at an early moment inadmissible load of the frog point. By continuously monitoring and checking the pre-tension forces of the screw connections by means of pressure cells or wire strain gauges, self-acting loosening of screw connections is recognized in time if a defined limit value is underpassed. Also from the conventional manner of monitoring the tongue contact, the tongue structure and the tongue opening by means of magnetic fields or induction fields or by means of infrared sensors, any change of the contacting behavior and, respectively, any inadmissible underpassing of limit values, in case of surface wear of the tongue rail can, in case of continuous supervision and detection, be recognized at an early time. Continuous supervision of the switching forces by means of the current consumption of the drive motor provides the possibility to recognize at an early moment when lubrication is needed, so that, in this manner, the required amount of lubricating agent can be reduced and the contamination of the environments resulting from the excessive use of lubricating agent is reduced.

What is claimed is:

1. A device for determining the condition of railway switches or railway crossings comprising at least one sensor for monitoring end positions of tongue rails for diagnosing wear thereof and for establishing maintenance intervals, wherein said sensor is arranged within an area of a theoretical frog point for determining deviations of railway wheel motion in at least one of a lateral and a height direction.

2. A device as claimed in claim 1, wherein the sensor is designed as a switch having an actuating member which is supported so as to be swivelable around a crossing axis extending in substantially normal relation to a plane of the rail surface or substantially in parallel relation to the plane of the rail face and in a direction of an angle bisector of the frog.

3. A device as claimed in claim 2, wherein the actuating member of the switch is of a conical shape flaring from an upper edge in a downward direction and from a front end in a direction towards a frog point.

4. A device as claimed in claim 2, wherein a pressure sensor for sensing vertical forces is connected with a bearing support of the actuating member.

5. A device as claimed in claim 1, wherein the sensor is formed of two spring leaves connected to include therebetween an acute angle, said spring leaves having wire strain gauges fixed on side surfaces thereof and having free ends thereof fixed on a base plate.

6. A device as claimed in claim 5, wherein the free ends of the spring leaves are bent in an outward direction and the wire strain gauges are fixed to the side surfaces between the bent portions.

7. A device as claimed in claim 5, wherein the wire strain gauges are arranged on mutually facing inner surfaces of the spring leaves.

8. A device as claimed in claim 5, wherein the sensor has a head, within the connecting area adjacent the connection of the spring leaves.

9. A device as claimed in claim 5, wherein a free space is formed between the spring leaves, said freespace being filled with a compound of permanent elasticity.

10. A device as claimed in claim 5, wherein the acute angle included between the spring leaves substantially corresponds to a flank angle of the frog point.

11. A device as claimed in claim 1, wherein said sensor is arranged between the theoretical frog point and an effective frog point.

12. A device as claimed in claim 1, wherein a rigid protective means is arranged to extend towards the theoretical frog point.

13. A device as claimed in claim 1, wherein the sensor is designed as a non-contact sensor.

14. A device as claimed in claim 1, wherein additional sensors for monitoring a minimum distance of a guide rail from the tongue rail are provided at a distance from the end of the tongue rail.

15. A device as claimed in claim 1, wherein means for indicating current input is connected with a current supply for a drive means for the railway switch, the current indicating means being monitored during a switching operation being indicated in an indicating device.

16. A device as claimed in claim 1, wherein pressure sensors for monitoring fixation of frog screws are additionally arranged between screw heads and washers, and are connected via measuring conduits with an evaluating circuit.

17. A device as claimed in claim 1, wherein the sensor is designed as a non-contact sensor and wherein said sensor produces a signal indicating contact of the tongue rail with a stock rail, as well as a signal indicating a distance from a contact position, said signals being supplied to an evaluating circuit.

18. A device as claimed in claim 17, wherein by monitoring contact of the tongue rail, conclusions on the wear condition thereof and penetration of foreign bodies between the stock rail and tongue rail are possible.

19. A device as claimed in claim 1, wherein a non-contact sensor and a mechanical sensor are arranged within an area of narrowest passage between a stock rail and the tongue rail to recognize deviations in distance between these which are below a limit value for preventing damage of components.

20. A device as claimed in claim 9, wherein said compound of permanent elasticity is one of a synthetic resin and a foamed material.

21. A device as claimed in claim 13, wherein said non-contact sensor is an IR-sensor.

22. A device as claimed in claim 15, wherein said indicating means is an ammeter.

* * * * *